US009039331B2

(12) United States Patent
Kaplan

(10) Patent No.: US 9,039,331 B2
(45) Date of Patent: May 26, 2015

(54) METHOD AND APPARATUS FOR A MODULAR UNDERWATER WEIGHTING SYSTEM

(76) Inventor: Jonathan Kaplan, San Antonio, TX (US)

( * ) Notice: Subject to any disclaimer, the term of this patent is extended or adjusted under 35 U.S.C. 154(b) by 86 days.

(21) Appl. No.: 13/476,966

(22) Filed: May 21, 2012

(65) Prior Publication Data

US 2013/0309019 A1 Nov. 21, 2013

(51) Int. Cl.
*B63C 11/30* (2006.01)
*B63C 11/02* (2006.01)

(52) U.S. Cl.
CPC ..... *B63C 11/02* (2013.01); *B63C 11/30* (2013.01)

(58) Field of Classification Search
CPC . B63C 11/30; B63C 2011/306; A63B 21/065
USPC ..... 405/186
See application file for complete search history.

(56) References Cited

U.S. PATENT DOCUMENTS 2,970,448 A * 2/1961 Di Julio ..... 405/186
4,732,305 A * 3/1988 Courtney et al. ..... 405/186
4,789,270 A * 12/1988 Selisky ..... 405/186
4,798,497 A * 1/1989 Bloos ..... 405/186
5,957,079 A * 9/1999 Wessels ..... 405/186
7,775,744 B1 * 8/2010 Lares ..... 405/186
2009/0317193 A1 * 12/2009 Wang ..... 405/186

FOREIGN PATENT DOCUMENTS

EP 0844962 * 6/1998
FR 1177872 * 4/1959
FR 1441887 * 6/1966
WO WO 2011056092 A1 * 5/2011

* cited by examiner

*Primary Examiner* — Frederick L Lagman
(74) *Attorney, Agent, or Firm* — Jonathan Kaplan

(57) ABSTRACT

A modular expandable weighting system for recreational and professional underwater divers that permits a user to selectively attach one or more individual weight units to each other to achieve a desired amount of weight to regulate the user's overall buoyancy while under water. When used with a weight belt, the weights when attached create channels through which a weight belt may be disposed. If two or less weights are attached, end caps may be attached to create the channels to allow the system to be attached to the weight belt. When used without a weight belt, such as on a buoyancy compensator device with multiple weight pockets, the weight system allows for the placement of exact amounts of weights to achieve the desired amount of overall buoyancy as well as to maintain the desired degree of horizontal trim.

7 Claims, 6 Drawing Sheets

METHOD AND APPARATUS FOR A MODULAR UNDERWATER WEIGHTING SYSTEM

BACKGROUND OF THE INVENTION

1. Field of the Invention

Figure 1:
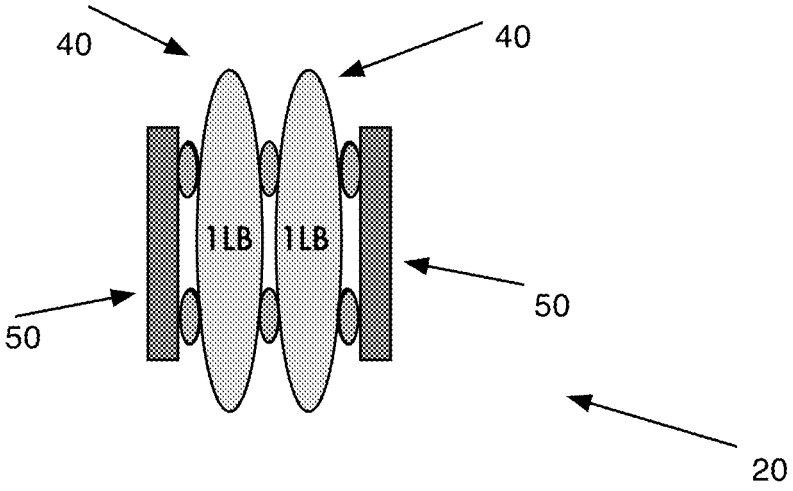

The present invention relates to a modular weighting system for recreational and professional underwater divers that permits the regulation of overall buoyancy and also allows for a specific distribution of weight over a diver's body to maintain the desired degree of horizontal trim.

2. Description of the Related Art

Scuba (Self Contained Underwater Breathing Apparatus) divers, whether recreational or professional, need to have precise control of their depth in the underwater environment. This is accomplished by achieving neutral buoyancy, a state of equilibrium where the positive and negative buoyancy forces acting on a diver under water are as close to equal as possible, allowing the diver to "hover" at their desired depth with little or no additional effort.

Effective buoyancy control is necessary for several reasons. First, proper buoyancy is necessary for safe and controlled ascents to the surface, the stage of a dive where a diver is most susceptible to pressure and decompression related injuries. Buoyancy control is also essential for maintaining and holding one's depth at safety and decompression stops (timed stops at specified depths to allow for absorbed gases to be released from a diver's body).

A diver without control over their buoyancy may collide with underwater hazards, which can result in the diver getting caught on, or injured by, these hazards. In addition, a diver who cannot control their buoyancy may cause damage to the underwater environment when they make contact with objects such as fragile coral reefs that take decades to develop and grow. Finally, a diver who maintains neutral buoyancy will not expend effort struggling to stay at a constant depth, thereby conserving their energy and reducing their air consumption.

Because the human body is in most cases positively buoyant, a diver usually needs to have additional negatively buoyant weight added to their diving equipment to reach a state of neutral buoyancy. Typically, this is done with lead weights either attached to a diving weight belt or by placing the weights inside of the weight pockets of a Buoyancy Compensator Device (BCD), an inflatable vest worn by divers.

As scuba equipment is added, removed or changed, the weight necessary to achieve neutral buoyancy changes. Scuba equipment may be positively or negatively buoyant, and the amount of buoyancy exhibited by an individual piece of equipment may change depending on several factors. Some of these factors are variable ones that change during the dive, such as depth and the air remaining in one's tank. A typical 80 cubic foot aluminum scuba tank when filled with air to 3000 PSI has a negative buoyancy of −1.4 lbs. When empty it has a positive buoyancy of +4.4 Lbs. When a diver descends to greater depths, the resulting pressure increase compresses a neoprene wetsuit, which reduces its buoyancy.

Other factors also change overall buoyancy. Once such example is the salinity of the water. Because salt water is denser than fresh water, additional weight is necessary to counter the increase in positive buoyancy when diving in salt water. An additional factor affecting a diver's buoyancy is whether the diver is wearing a wetsuit, and the thickness of the wetsuit. In warm tropical waters, a diver may not wear a wetsuit. In cooler waters, a diver may wear a 3 mm, 5 mm or even a 7 mm wetsuit. Each has significantly different positive buoyancy characteristics.

Because of the different conditions and equipment used for each type of dive, a diver has to change the amount of weight they use depending on the type of dive. A 200 pound diver that plans a dive for a warm freshwater lake without a wetsuit may only need 10 pounds of weight to maintain neutral buoyancy. That same diver in a 3 mm wetsuit in freshwater may require 14 pounds of weight to maintain neutral buoyancy. In saltwater with the same 3 mm wetsuit, the diver may require 18 pounds of weight to maintain neutral buoyancy.

In addition to overall weight, the placement of the weight on a diver effects the diver's orientation in the water. Ideally, a diver should maintain a flat trim in the water, wherein the orientation of their body is as close to horizontal as possible. With a diver's body in a horizontal position, the resistance in the water is reduced, thereby minimizing the amount of energy needed to swim. Also, if a diver does not maintain horizontal trim, the propulsion generated by the divers fins is directed partially upward or downward instead of horizontally, making it difficult to maintain the desired depth and causing the diver to expend additional energy to counter the upward or downward movement.

Modern BCDs contain several pockets in which weight can be added for buoyancy, as well as to aid in maintaining horizontal trim. Typically, a BCD will have removable (dumpable) weight pockets around the waist and non-dumpable weight near the shoulders. By placing weight in the pockets above and below the diver's horizontal center-of-gravity, a diver can adjust the amount of weight between these upper and lower pockets to help maintain horizontal trim.

Because the amount of weight necessary to maintain overall neutral buoyancy can vary, and the distribution of weight necessary to maintain horizontal trim when using BCDs with multiple pockets can also vary, being able to make precise weight adjustments in small increments can be advantageous in helping a diver be safe, comfortable and energy efficient underwater.

Scuba weights typically are made from cast lead and are manufactured in weight amounts typically between 1 and 5 pounds. They may be coated in rubber or plastic. Divers must buy or rent these weights in different configurations depending on the type of dive.

For divers using BCDs with multiple weight pockets, several different configurations may be necessary depending on the type of dive. In the example mentioned above, the diver in a 3 mm wetsuit diving in a freshwater requiring 14 pounds of weight to maintain neutral buoyancy may need to configure their overall weight using a 4 pound weight in each of their 2 dumpable weight pockets below their horizontal center-of-gravity and placing a 3 pound weight in each of their 2 non-dumpable weight pockets above their horizontal center-of-gravity. This allows for an overall total weight of 14 pounds and also spreads the weight out across the diver's body to maintain horizontal trim. If the diver decides to dive in the same freshwater lake when the water is warmer, they may decide to do so without a wetsuit. This may change the configuration to 10 pounds of overall weight with each of the 2 dumpable weight pockets containing 3 pound weights and the 2 non-dumpable pockets containing a 2 pound weight. Should the same diver choose to dive in the ocean wearing a 3 mm wetsuit, they may need 18 pounds of total weight, a pair of 5 pound weights in the dumpable pockets and a pair of 4 pound weights in the non-dumpable pockets.

For these 3 different examples, the diver would need a pair of 2 pound weights, a pair of 3 pound weights, a pair of 4 pound weights and a pair of 5 pound weights, for a total of 28 pounds, to achieve the various configurations needed for just the 3 examples given. Other factors may also change the required weight amounts, such as different equipment arrangements, wetsuits in 5 mm, 7 mm or greater thicknesses, the diver losing or gaining weight, etc. This may require a diver to purchase far more weight in total then they would ever need to achieve the different configurations necessary for any individual type of dives. This problem is even greater for diving operations such as retail dive shops, commercial diving companies and military dive units that must be able to configure weights for several people simultaneously taking part in diving classes, missions or trips.

While divers using weight belts would only be concerned about the overall weight used on the dive belt, any improvement to a weight system for BCD users must be compatible with those divers that prefer to use a weight belt.

SUMMARY OF THE INVENTION

In accordance with the present invention, a modular weight unit, comprising a weight body, which may be fully or partially enclosed in a casing, with said weight unit having a first securing member on the upper section of one side and a second securing member on the lower section of the same side. The weight unit is further comprised of a third securing member on the upper section and a fourth securing member on the lower section of the side opposite the side containing the first securing member and second securing member. The first securing member and fourth member in the preferred embodiment would be similar, as would be the second securing member and third securing member. The first securing member would be complimentary in shape with the third securing member to allow the first securing member to either receive or be received by the third securing member of a similar weight unit to attach and lock together. The second securing member would be complimentary in shape with the fourth securing member to allow the second securing member to either receive or be received by the fourth securing member of a similar weight unit to attach and lock together. The attachment of the first securing member and second securing member of one weight unit to the third securing member and fourth securing member of a similar weight unit allows the formation of a chain of weight units configurable to a desired weight with a channel created between the attached weight units within which to place a weight belt, if one is used.

For weight belt users, to create channels on a single or 2 connected weight units, a terminating end cap comprised of a cap body, a first cap securing member and a second cap securing member is attached to either the first securing member and second securing member of one side of a weight unit or the third securing member and fourth securing member of the opposite side of a weight unit. The first cap securing member would be complimentary in shape with the first securing member to allow the first cap securing member to either receive or be received by the first securing member of a weight unit to attach and lock together. The second cap securing member would be complimentary in shape with the second securing member to allow the second cap securing member to either receive or be received by the second securing member of a weight unit to attach and lock together. When the terminating end cap is inverted, The first cap securing member would be complimentary in shape with the fourth securing member to allow the first cap securing member to either receive or be received by the fourth securing member of a weight unit to attach and lock together. The second cap securing member would also be complimentary in shape with the third securing member to allow the second cap securing member to either receive or be received by the third securing member of a weight unit to attach and lock together.

An example of how the various configurations of the system would be used will be described. Two divers decide to take a trip in which they will dive one day in the Gulf of Mexico during the summer when the temperature is 84 degrees Fahrenheit. The next day they will move inland to dive a spring-fed cavern with a year round temperature of 71 degrees Fahrenheit. Diver A is a 200 pound male and uses a BCD with 4 weight pockets, 2 at shoulder level and 2 at his waist. Diver B is a 120 pound female and uses a backplate and wing buoyancy control system which does not have weight pockets, requiring Diver B to wear her weights on a weight belt around her waist. On the first day, Diver A will wear a 3 mm wetsuit in saltwater, requiring him to wear 16 pounds of weight to achieve neutral buoyancy. Diver A best maintains horizontal trim when he places 4 pounds of weight in each of his 4 weight pockets for this type of dive. Diver B tolerates cold better than Diver A and decides not to wear a wet suit. She requires 7 pounds of weight on her weight belt.

On the second day of diving in fresh water at cooler temperatures, Diver A wears the same 3 mm wetsuit but because the dive is in fresh water, he now requires only 12 pounds of weight. Diver A places 3 pounds of weight in each of his 4 weight pockets. Diver B decides to wear a 3 mm wetsuit for this dive, requiring her to place 5 pounds of weight on her weight belt.

Combined, both divers require a total amount of 24 pounds of weight on the first dive and 17 pounds of weight on the second dive. Using a modular weight system made up of 1 pound weight units, the divers only must bring 24 individual 1 pound weight units to achieve the desired weight configurations for both dives.

For the first dive, Diver A would connect 4 individual weight units together to form a 4 pound weight unit chain. He would place this into 1 of his BCD weight pockets. He would repeat this process for the other 3 weight pockets. This would give him a total of 16 pounds of weight, with 8 pounds above and 8 pounds below his center of gravity, allowing him to maintain neutral buoyancy and horizontal trim. The next day, he would disconnect a one pound weight unit from each of the 4 weight unit chains, giving him 3 pounds in each weight pocket.

Because Diver B is using a weight belt, the connection of weight units together form channels that she can place her weight belt through to secure the weights to the belt. However, when only using 1 or 2 individual weights, terminating end caps must be attached to the weight chain to form the necessary 2 channels to dispose the weight belt through.

Diver B for the first day finds that she is most comfortable when she places 2 weight unit chains of 3 pounds on each side of her belt and 1 individual weight unit positioned in between them. She connects 3 individual weight units together and threads a weight belt in the channels created between the 2 outer weight units and the middle weight unit. She then takes an individual weight unit, connects terminating end caps on each side of the weight unit and threads the weight belt in the channels created between the terminating end cap and the weight unit. Finally, she connects 3 more individual weight units together and threads the weight belt in the channels created between the 2 outer weight units and the middle weight unit. This gives her a total of 7 pounds spread evenly across the weight belt.

On the second day, Diver B decides to place 2 weight unit chains of 2 pounds each and an individual weight unit on her belt. She connects 2 individual weight units together, connects terminating end caps on each side of the 2 weight unit and threads the weight belt in the channels created between the terminating end caps and the weight units. She then takes an individual weight unit, connects terminating end caps on each side of the weight unit and threads the weight belt in the channels created between the terminating end cap and the weight unit. She attaches the final 2 pound weight unit chain in the same way as the first, giving her a total of 5 pounds positioned evenly across the weight belt.

It is therefore an object of this invention to provide a modular weight system for underwater divers that allows a user to attach sufficient weight units together to achieve a total amount of weight to maintain neutral buoyancy while submerged, with or without a weight belt.

It is a further object of the present invention to provide a modular weight system for underwater divers that allows for customizable configurations of weight between various weight attachment points above, below and on either side of a diver's horizontal center of gravity to achieve horizontal trim while submerged.

It is yet a further object of the present invention to provide a modular weight system that allows a diver to attach sufficient weight units together and whereby a channel is created on the end weight units through which a weight belt may be disposed and secured to a diver's body.

It is yet a further object of the present invention to provide a modular weight system that allows a diver, dive shop, commercial diving business or military diving operation to stock only enough weight as necessary for the individual or group of diver's maximum weighting requirements.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTIONS OF THE DRAWINGS

FIG. 1 provides a front view of a first embodiment of the present invention, 2 weight units connected with end caps to form channels for a weight belt.

Figure 2:
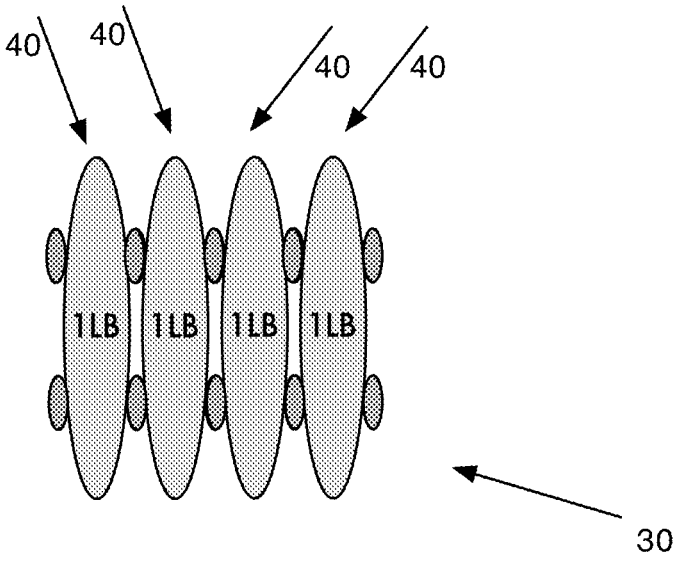

FIG. 2 provides a front view of a second embodiment of the present invention, 4 weight units connected that can be used with or without a weight belt.

Figure 3:
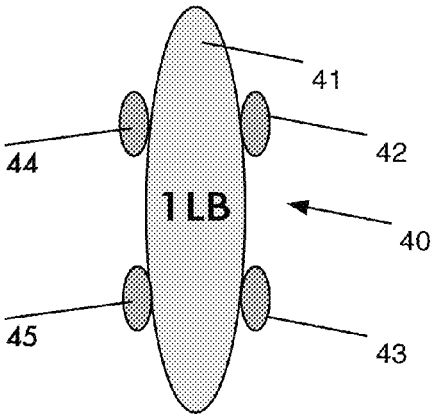

FIG. 3 provides a front view of an individual weight unit.

Figure 4:
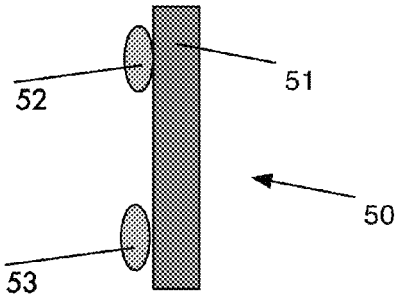

FIG. 4 provides a side view of an unconnected terminating end cap according to a first embodiment of the invention.

Figure 5:
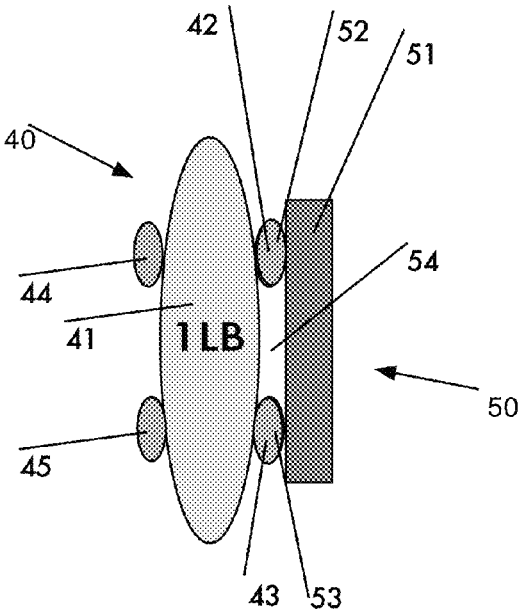

FIG. 5 provides a front view of an individual weight unit with a connected terminating end cap according to a first embodiment of the invention.

Figure 6:
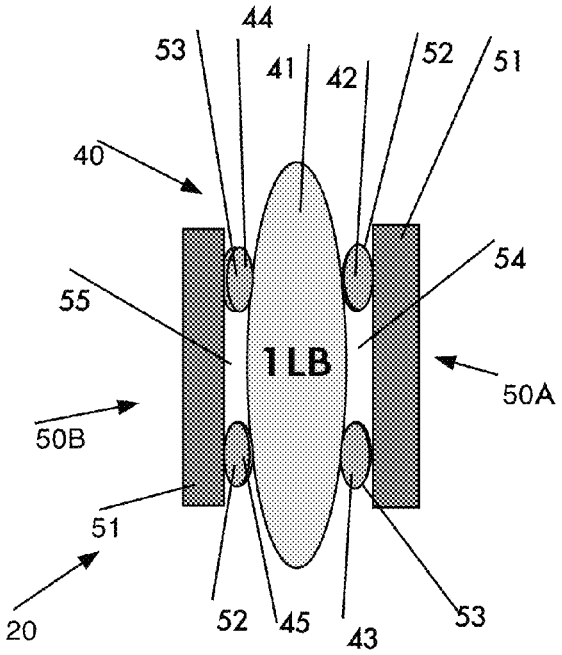

FIG. 6 provides a front view of an individual weight unit with connected terminating end caps on each side according to a first embodiment of the invention.

Figure 7:
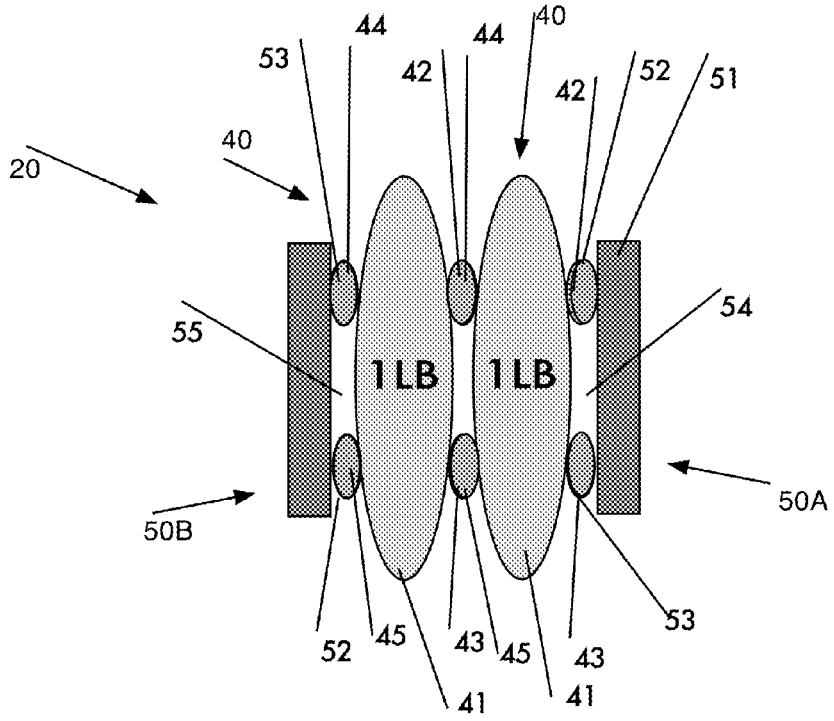

FIG. 7 provides a front view of 2 weight units connected to each other with terminating end caps according to a first embodiment of the invention.

Figure 8:
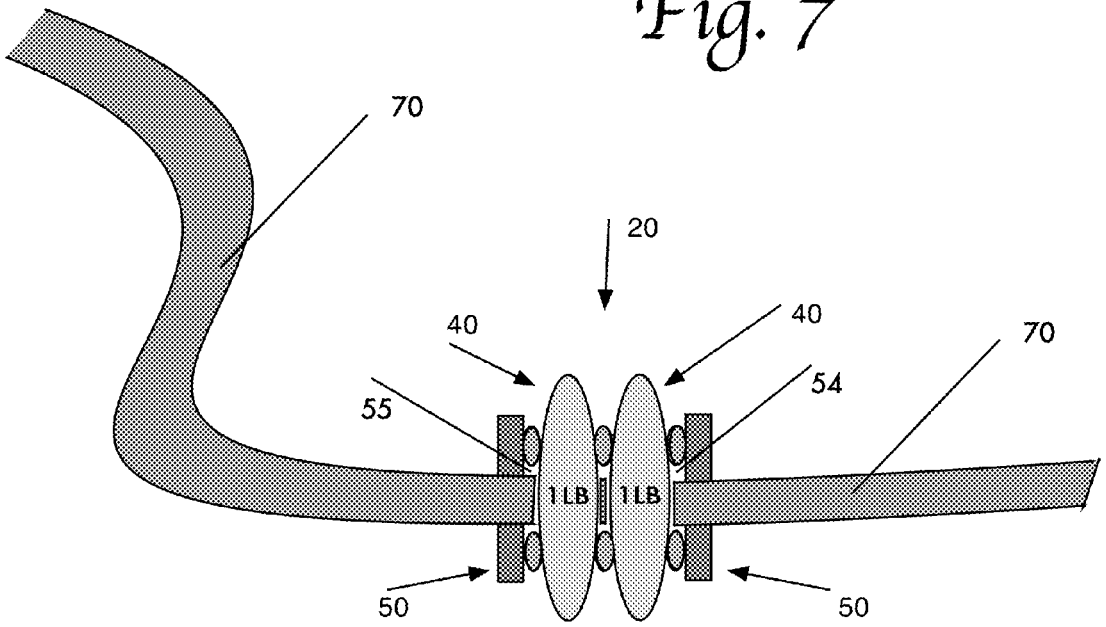
Figure 9:
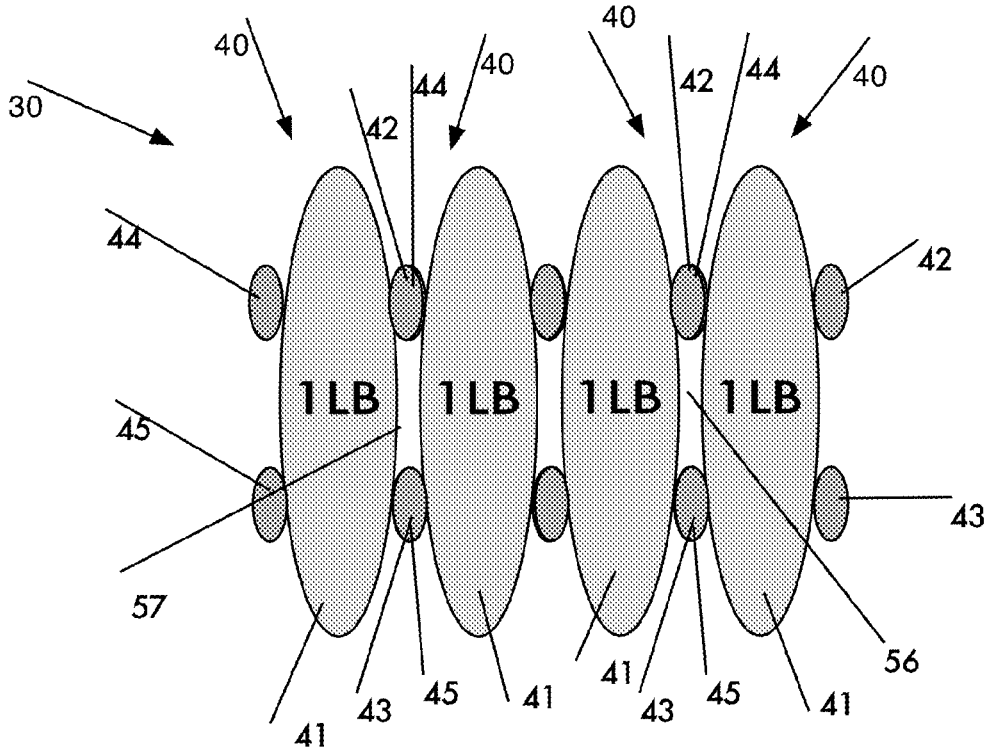

FIG. 8 provides a front view of 2 weight units connected to each other with terminating end caps attached to a weight belt according to a first embodiment of the invention FIG. 9 provides a front view of 4 weight units connected to each other with weight belt channels formed between the end weight units and adjacent weight units, according to a second embodiment of the invention.

Figure 10:
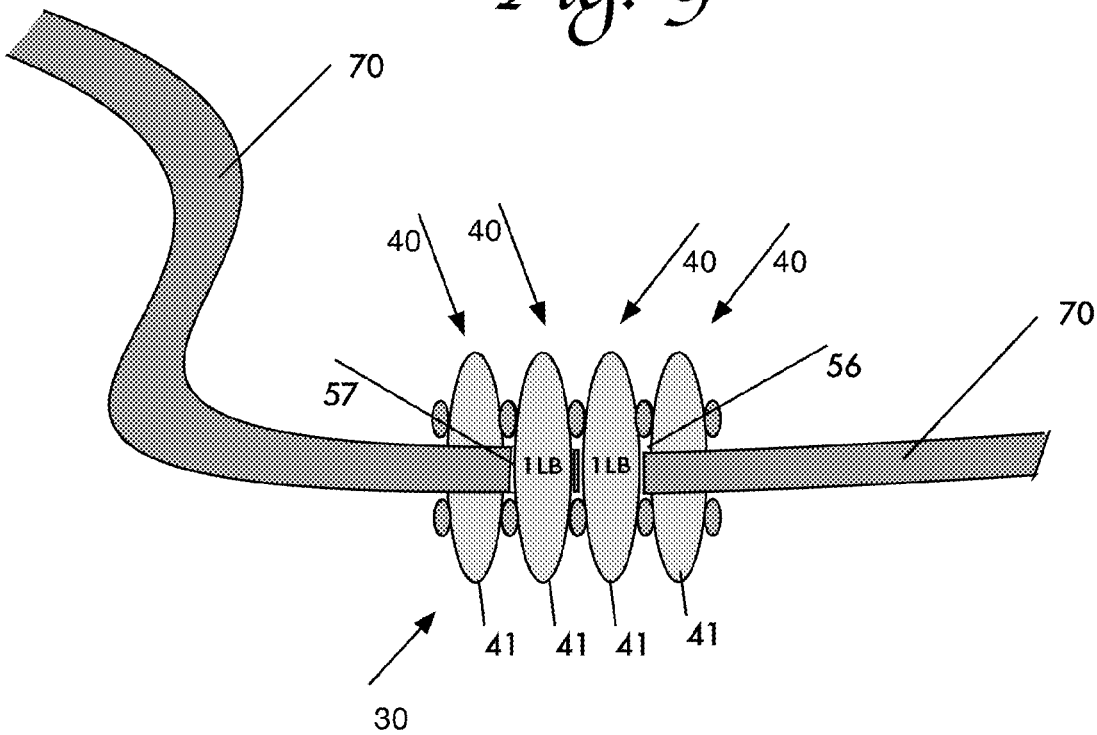

FIG. 10 provides a front view of 4 weight units connected to each other and attached to a weight belt according to a second embodiment of the invention.

Figure 11:
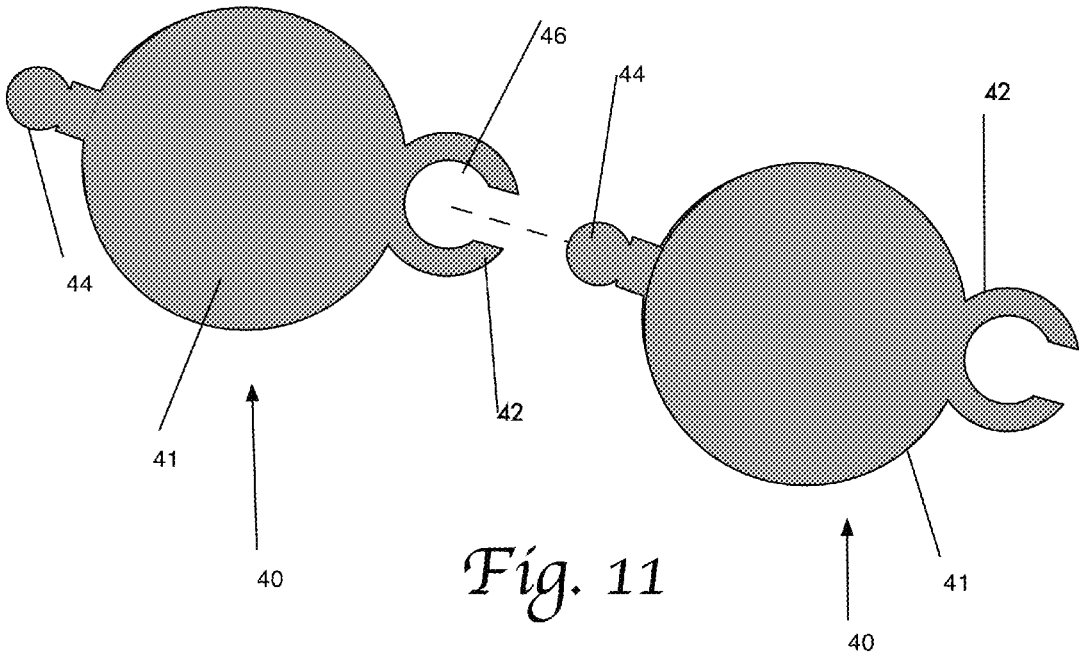

FIG. 11 provides a top view of an individual weight unit and third securing member prior to being attached to another individual weight unit by its first securing member.

Figure 12:
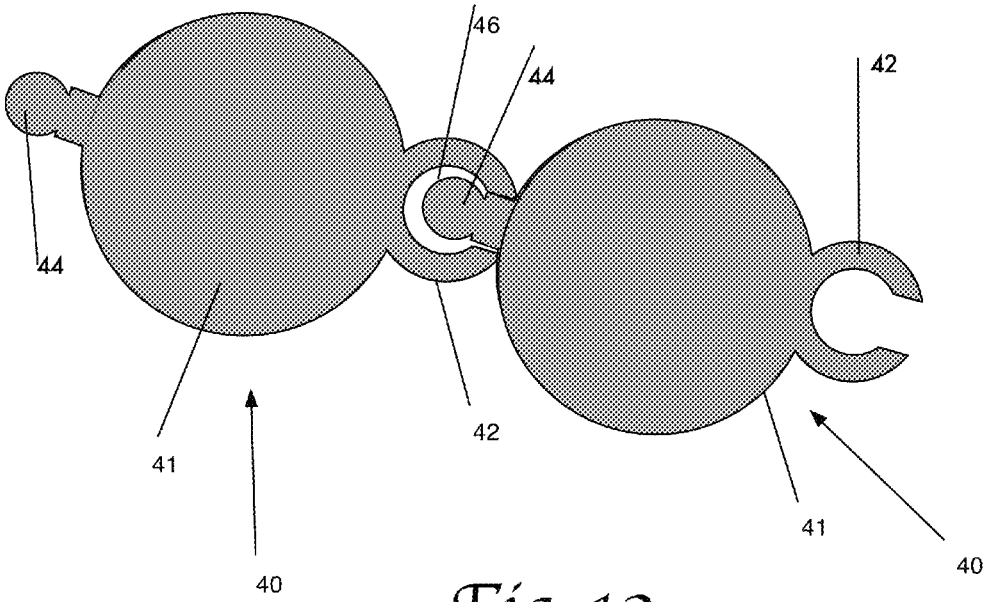

FIG. 12 provides a top view of 2 connected weight units with the third securing member and first securing member snap connected together.

Figure 13:
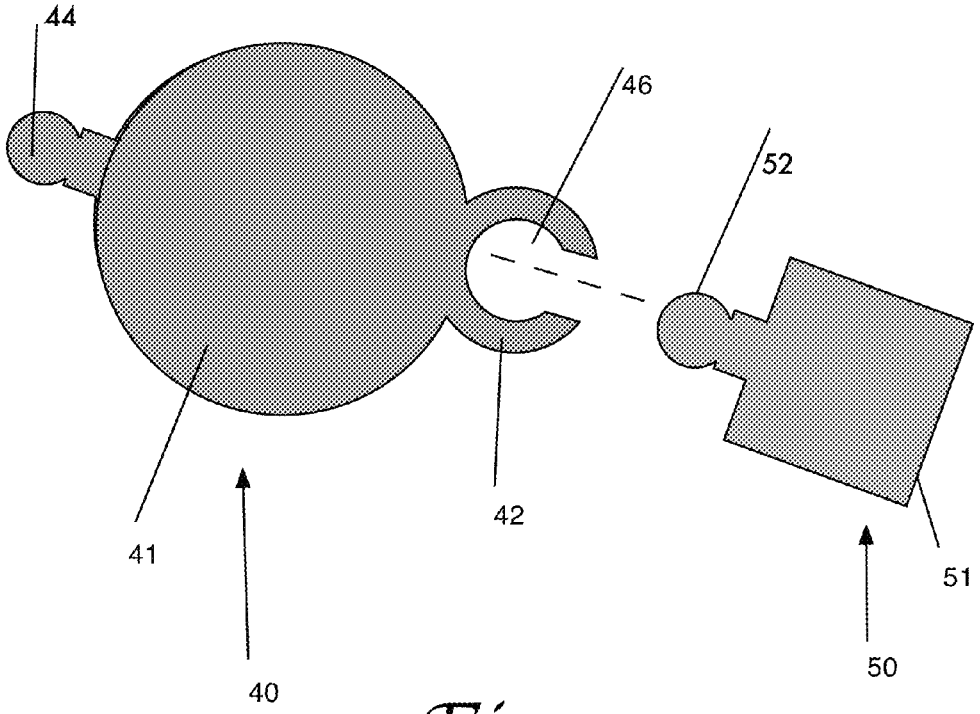

FIG. 13 provides a top view of an individual weight unit and its first securing member prior to being connected to a terminating end cap by its first cap securing member.

Figure 14:
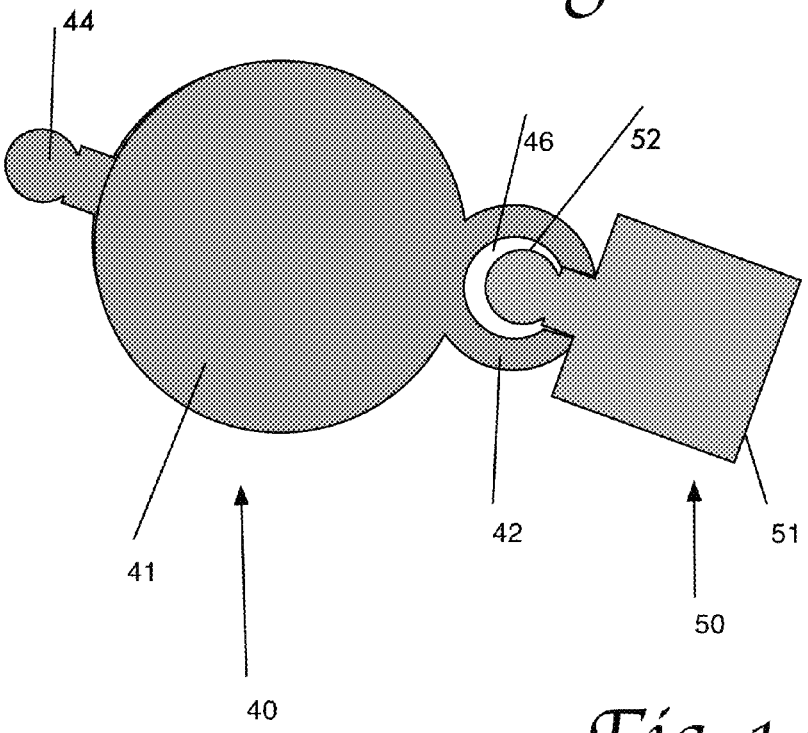

FIG. 14 provides a top view of an individual weight unit and a terminating end cap with first securing member and the first cap securing member snap connected together.

DETAILED DESCRIPTION OF THE PREFERRED EMBODIMENT

Detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

In general, the present invention relates to a modular underwater diving weight system. More specifically, the present invention allows an underwater diver the ability to customize the amount of weight either attached to a weight belt or secured to a diver's body or equipment, such as a buoyancy compensator device, to achieve neutral buoyancy and horizontal trim by interconnecting modular components.

As illustrated in FIGS. 1-13, a modular weight system 20, which is comprised of either one individual or two attached weight units 40 with attached terminating end caps 50 for use with a weight belt as a first embodiment, and a modular weight system 30 which is comprised of one or more attached weight units 40, wherein 3 or more attached weight units 40 may be used with or without a weight belt, in a second embodiment.

In FIG. 1, according to the first embodiment of the invention, using one pound weight units 40 by example, a modular weight system 20 for the connection of less than three weight units 40 to each other to be worn on a weight belt, shows a weight unit 40 connected to a corresponding weight unit 40, with a terminating end cap 50 connected to each end.

In FIG. 2, according to the second embodiment of the invention, using one pound weight units 40 by example, the connection of three or more weight units 40 to be worn on a weight belt or any number of weight units 40 without a weight belt, shows four weight units 40 connected to each other.

In FIG. 3, an individual weight unit 40 showing a weight body 41, with a first securing member 42, a second securing member 43, a third securing member 44 and a fourth securing member 45, allowing multiple weight units 40 to connect to each other to form a chain.

In FIG. 4, according to the first embodiment of the invention, when a single modular weight units 40 or 2 weight units 40 (not shown) are connected together to be used on a weight belt, a terminating end cap 50, which is comprised of a cap body 51, a first cap securing member 52 and a second cap securing member 53.

In FIG. 5, according to the first embodiment of the invention, the weight unit 40 with terminating end cap 50 is shown, comprised of the weight body 41, with a first securing member 42 and a second securing member 43 extending from a side of the weight body 41, and a third securing member 44 and a fourth securing member 45 extending from the opposing side. Terminating end cap 50, comprised of cap body 51, from which first cap securing member 52 and second cap securing member 53 extending from the side of the cap body 51 to connect to weight unit 40 corresponding first securing member 42 and a second securing member 43 which are complimentary in shape to allow connection, and forming belt channel 54.

In FIG. 6, according to the first embodiment of the invention, modular weight system 20 is shown, comprising the weight unit 40 with terminating end caps 50 connected on both sides. The weight unit 40 comprised of the weight body 41, with a first securing member 42 and a second securing member 43 extending from a side of the weight body 41, and a third securing member 44 and a fourth securing member 45 extending from the opposing side. A first terminating end cap 50A, comprised of cap body 51, from which first cap securing member 52 and second cap securing member 53 extend from the side of the cap body 51 to connect to weight unit 40 first securing member 42 and a second securing member 43 which are complimentary in shape to allow connection. A second terminating end cap 50B, comprised of cap body 51, from which first cap securing member 52 and second cap securing member 53 extending from the side of the cap body 51, is inverted in relation to terminating end cap 50A to connect to weight unit 40 corresponding third securing member 44 and a fourth securing member 45 which are complimentary in shape to allow connection. The connection of terminating end caps 50A and 50B to weight unit 40 forms belt channel 54 and belt channel 55.

In FIG. 7, according to the first embodiment of the invention, a modular weight system 20 is shown, comprising two weight units 40 with terminating end caps 50 connected on both sides. The weight units 40 are comprised of the weight body 41, with a first securing member 42 and a second securing member 43 extending from a side of the weight body 41, and a third securing member 44 and a fourth securing member 45 extending from the opposing side. A first weight unit 40 attaches to a second weight unit 40 with first securing member 42 and a second securing member 43 of the first weight unit 40 connecting to third securing member 44 and a fourth securing member 45 of the second weight unit 40. A first terminating end cap 50A, comprised of cap body 51, from which first cap securing member 52 and second cap securing member 53 extending from the side of the cap body 51 to connect to weight unit 40 corresponding third securing member 42 and a fourth securing member 43 of the first weight unit 40 which are complimentary in shape to allow connection. A second terminating end cap 50B, comprised of cap body 51, from which first cap securing member 52 and second cap securing member 53 extending from the side of the cap body 51, is inverted in relation to terminating end cap 50A to connect to the second weight unit 40 corresponding third securing member 44 and a fourth securing member 45 which are complimentary in shape to allow connection. The connection of terminating end caps 50A and 50B to weight unit 40 forms belt channel 54 and belt channel 55.

In FIG. 8, according to the first embodiment of the invention, the modular weight system 20 is shown with weight belt 70 disposed between belt channel 54 and belt channel 55 to attach the modular weight system 20 as described in FIG. 7 to weight belt 70.

In FIG. 9, according to the second embodiment of the invention, a modular weight system 30 is shown, in this example showing four connected weight units 40. The weight units 40, are comprised of the weight body 41, with a first securing member 42 and a second securing member 43 extending from a side of the weight body 41, and a third securing member 44 and a fourth securing member 45 extending from the opposing side. Each weight unit 40 attaches to a another weight unit 40 with first securing member 42 and a second securing member 43 of the first weight unit 40 connecting to third securing member 44 and a fourth securing member 45 of the second weight unit 40, forming a chain of weight units in an amount determined by the user. When more than three weight units 40 are connected together, the outermost weight unit on either side form belt channel 56 and belt channel 57 with the weight unit 40 it connects to.

In FIG. 10, according to the second embodiment of the invention, the modular weight system 30 is shown with weight belt 70 disposed between belt channel 56 and belt channel 57 to attach the modular weight system 30 as described in FIG. 9 to weight belt 70.

In FIG. 11, according to the first or second embodiment of the invention, two individual weight units 40 are shown prior to attachment. Weight unit 40 is comprised of the weight body 41, with a first securing member 42 and a second securing member 43 (not shown) extending from a side of the weight body 41, and a third securing member 44 and a fourth securing member 45 (not shown) extending from the opposing side. In this drawing, the first securing member 42 of the first weight unit 40 is shaped to form a cavity 46, complimentary in shape to the third securing member 44 of the second weight unit 40, allow the snap-connection of the weight units 40 to each other.

In FIG. 12, according to the first or second embodiment of the invention, two individual weight units 40 are shown connected to each other. Weight unit 40 is comprised of the weight body 41, with a first securing member 42 and a second securing member 43 (not shown) extending from a side of the weight body 41, and a third securing member 44 and a fourth securing member 45 (not shown) extending from the opposing side. In this drawing, the first securing member 42 of the first weight unit 40 is shaped to form a cavity 46, complimentary in shape to the third securing member 44 of the second weight unit 40, with the third securing member 44 of the second weight unit 40 disposed within cavity 46 of the first securing member 42 of the first weight unit, securing the weight units 40 to each other.

In FIG. 13, according to the first embodiment of the invention, an individual weight unit 40 is shown prior to attachment to a terminating end cap 50. Weight unit 40 is comprised of the weight body 41, with a first securing member 42 and a second securing member 43 (not shown) extending from a side of the weight body 41, and a third securing member 44 and a fourth securing member 45 (not shown) extending from the opposing side. Terminating end cap 50 is comprised of cap body 51, first cap securing member 52 and a second cap securing member 53 (not shown). In this drawing, the first securing member 42 of the weight unit 40 is shaped to form a cavity 46, complimentary in shape to the first cap securing member 52 of the terminating end cap 50, allowing the snap-connection of the weight unit 40 to the terminating end cap 50. To snap connect the terminating end cap 50 to the opposite side of weight unit 40, the terminating end cap 50 is inverted (not shown).

In FIG. 14, according to the first embodiment of the invention, an individual weight unit 40 is shown connected to a terminating end cap 50. Weight unit 40 is comprised of the weight body 41, with a first securing member 42 and a second securing member 43 (not shown) extending from a side of the weight body 41, and a third securing member 44 and a fourth securing member 45 (not shown) extending from the opposing side. Terminating end cap 50 is comprised of first cap securing member 52 and a second cap securing member 53 (not shown). In this drawing, the first securing member 42 of the weight unit 40 is shaped to form a cavity 46, complimentary in shape to the first cap securing member 52 of the terminating end cap 50, with the first cap securing member 52 of the terminating end cap 50 disposed within cavity 46 of the first securing member 42. To snap connect the terminating end cap 50 to the opposite side of weight unit 40, the terminating end cap 50 is inverted (not shown).

While these drawings show a securing members disposing into another securing member or cap securing member, this is one example only of a suitable attachment method. Other attachment methods may be used, such as pins and holes, mushroom heads and holes, tongue and groove, tab and groove, slots and tabs, Velcro, sliding tabs and grooves, lockable hinges and other suitable types of fasteners. The connectors may be integrally formed from the sides or walls of the modular weight body, or the connectors may be attached to the weight body as separate elements.

Although the present invention has been described in terms of the foregoing preferred embodiments, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

I claim:

1. A modular expandable weight system, comprising:

a modular weight unit comprising:

a weight body having a plurality of sides; and a means for selectively attaching said modular weight unit to other modular weight units, wherein the weight body has an attachment means comprising at least four securing members, with at least two securing members being exteriorly located on each of two opposing sides of said plurality of sides, wherein when two modular weight units are attached by the connection of the at least two securing members on one side of a weight body with the at least two securing members on the opposing side of another weight body, a channel is formed between the at least two securing members of one side of the weight body and the at least two securing members on an opposing side of the other weight body, allowing a weight belt to be disposed through the channels between the one or modular weight units and the terminating end caps;

a terminating end cap, comprising:

a cap body having a plurality of sides; and a means for attaching said terminating end cap to a modular weight unit, wherein the cap body has an attachment means comprising at least two securing members, said securing members being exteriorly located on one side of said plurality of sides, wherein when the at least two securing members on one side of a weight body are attached to the at least two securing members on a terminating end cap, a channel is formed between the at least two securing members of one side of the weight body and the at least two securing members on the terminating end cap, allowing a weight belt to be disposed through the channels between the one or modular weight units and the terminating end caps.

2. The securing members of claim 1, where the securing members are chosen from a group consisting of male and female snap connectors, interlocking slide connectors, pins and holes, mushroom heads and holes, tongue and groove, tab and groove, slots and tabs, Velcro, sliding tabs and grooves, and lockable hinge connectors.

3. The modular weight unit of claim 1, wherein the weight of the modular weight unit is one pound.

4. A method of regulating an underwater diver's buoyancy utilizing a modular expandable weight system, comprising one or more modular weight units, two terminating end caps and a scuba weight belt, wherein:

said modular weight units are comprised of:

a weight body having a plurality of sides; and a means for selectively attaching said modular weight unit to other modular weight units, wherein the weight body has an attachment means comprising at least 4 securing members, with at least two securing members being exteriorly located on each of two opposing sides of said plurality of sides, wherein when two modular weight units are attached by the connection of the at least two securing members on one side of a weight body with the at least two securing members on the opposing side of another weight body, a channel is formed between the at least two securing members of one side of the weight body and the at least two securing members on an opposing side of the other weight body;

said terminating end cap, comprising:

a cap body having a plurality of sides; and a means for attaching said terminating end cap to a modular weight unit, wherein the cap body has an attachment means comprising at least two securing members, said securing members being exteriorly located on one side of said plurality of sides, wherein when the at least two securing members on one side of a weight body are attached to the at least two securing members on a terminating end cap, a channel is formed between the at least two securing members of one side of the weight body and the at least two securing members on the terminating end cap, wherein an individual or selective number of modular weight units are attached together to achieve a desired weight, the terminating end caps are attached to the remaining unattached at least two securing members on each side of the at least one individual or chain of modular weight units, and a weight belt is disposed through the channels between the one or modular weight units and the terminating end caps.

5. A method of regulating an underwater diver's buoyancy utilizing a modular expandable weight system comprising:

a modular weight unit comprised of:

a weight body having a plurality of sides; and a means for selectively attaching said modular weight unit to other modular weight units, wherein the weight body has an attachment means comprising at least four securing members, with at least two securing members being exteriorly located on each of two opposing sides of said plurality of sides, wherein when two modular weight units are attached by the connection of the at least two securing members on one side of a weight body with the at least two securing members on the opposing side of another weight body, a channel is formed between the at least two securing members of one side of the weight body and the at least two securing members on an opposing side of the other weight body, allowing a weight belt to be disposed through the channels between the one or modular weight units and the terminating end caps, wherein the user selectively attaches the desired amount of modular weight units together to achieve a desired weight and affixes the resulting modular expandable weight system to their body with a securing members to achieve the necessary degree of buoyancy.

6. The method of claim 5, wherein the securing method to regulate an underwater diver's buoyancy is the placement of the modular expandable weight system in at least one pocket of a buoyancy compensator device.

7. The method of claim 6, wherein the regulation of an underwater diver's buoyancy is accomplished by placement of the modular expandable weight systems in multiple pockets of a buoyancy compensator device to control the amount of overall buoyancy and regulate the user's horizontal trim.

* * * * *